US008302535B2

(12) United States Patent
Chase

(10) Patent No.: US 8,302,535 B2
(45) Date of Patent: Nov. 6, 2012

(54) TRAIN YARD CLASSIFICATION SYSTEM

(76) Inventor: Thomas B. Chase, Winnsboro, SC (US)

( * ) Notice: Subject to any disclaimer, the term of this patent is extended or adjusted under 35 U.S.C. 154(b) by 96 days.

(21) Appl. No.: 12/806,280

(22) Filed: Aug. 9, 2010

(65) Prior Publication Data

US 2012/0031295 A1 Feb. 9, 2012

(51) Int. Cl.
*B61L 17/00* (2006.01)
*B61J 1/10* (2006.01)

(52) U.S. Cl. ..... 104/26.1; 104/48; 104/50; 104/29; 104/137

(58) Field of Classification Search ..... 104/48, 104/50, 130.6, 35, 281, 282, 283, 284, 286, 104/27, 29, 30, 26.1, 137; 213/211, 212, 213/213
See application file for complete search history.

(56) References Cited

U.S. PATENT DOCUMENTS

| | | | | |
|---|---|---|---|---|
| 889,368 | A | | 6/1908 | Hawley |
| 1,366,292 | A | * | 1/1921 | Smith ..... 104/48 |
| 3,727,559 | A | | 4/1973 | McCune et al. |
| 3,865,042 | A | | 2/1975 | DePaola et al. |
| 3,901,390 | A | | 8/1975 | Giovanelli |
| 4,324,185 | A | | 4/1982 | Vinson |
| 4,354,792 | A | | 10/1982 | Cornish |
| 4,487,547 | A | | 12/1984 | Cornish et al. |
| 4,610,206 | A | | 9/1986 | Kubala et al. |
| 5,168,183 | A | | 12/1992 | Whitehead |
| 5,450,226 | A | | 9/1995 | Khan et al. |
| 5,531,337 | A | | 7/1996 | Cappelletti et al. |
| 5,758,848 | A | | 6/1998 | Beule |
| 5,777,547 | A | | 7/1998 | Waldrop |
| 6,006,673 | A | | 12/1999 | Brandt |
| 6,402,118 | B1 | | 6/2002 | Nijsse et al. |
| 6,418,854 | B1 | | 7/2002 | Kraft |
| 6,418,857 | B1 | | 7/2002 | Okano et al. |

(Continued)

FOREIGN PATENT DOCUMENTS

| | | |
|---|---|---|
| EP | 0177705 | 4/1986 |

(Continued)

OTHER PUBLICATIONS

International Search Report mailed Apr. 6, 2012 in corresponding PCT Application No. PCT/US2011/046931.

*Primary Examiner* — Mark Le
(74) *Attorney, Agent, or Firm* — Edwards Wildman Palmer LLP; George W. Neuner

(57) ABSTRACT

A system for transferring railroad cars from incoming receiving tracks to classification tracks for building outgoing trains includes a plurality of incoming receiving tracks, a plurality of outgoing classification tracks and one or more transfer tables for moving railroad cars from the incoming receiving tracks to designated outgoing classification tracks. Each transfer table has a plurality of track segments. Incoming railroad cars are received on a plurality of incoming receiving tracks. A first car is uncoupled from a following second car on each of the receiving tracks having cars. The uncoupled first car is moved from the incoming receiving track onto a corresponding track segment on the transfer table. The transfer table is moved to align a selected track segment with an appropriate classification track for the corresponding railroad car. The transfer table is moved and aligned with appropriate classification tracks until each railroad car has been transferred to the appropriate classification track. The steps are repeated until all of the cars have been classified and transferred to classification tracks or held back for later transfer.

4 Claims, 14 Drawing Sheets

U.S. PATENT DOCUMENTS

| | | | | |
|---|---|---|---|---|
| 6,684,794 | B2 | 2/2004 | Fiske et al. | |
| 6,931,995 | B2 | 8/2005 | Yokonishi et al. | |
| 7,206,676 | B2 * | 4/2007 | Cross et al. | 701/19 |
| 7,377,219 | B2 | 5/2008 | Brandt | |
| 7,380,508 | B2 | 6/2008 | Li | |
| 7,587,982 | B2 | 9/2009 | Li | |
| 7,596,433 | B2 | 9/2009 | Muinonen et al. | |
| 2003/0000415 | A1 * | 1/2003 | Lamb et al. | 104/281 |
| 2003/0198544 | A1 | 10/2003 | Campbell et al. | |
| 2003/0217668 | A1 | 11/2003 | Fiske et al. | |
| 2004/0213652 | A1 | 10/2004 | Campbell et al. | |
| 2006/0219128 | A1 | 10/2006 | Li | |
| 2007/0095245 | A1 | 5/2007 | Li | |
| 2008/0148988 | A1 | 6/2008 | Wamble | |
| 2008/0148990 | A1 | 6/2008 | Wamble et al. | |
| 2008/0148991 | A1 | 6/2008 | Wamble et al. | |
| 2009/0103227 | A1 | 4/2009 | Morishita | |
| 2009/0249973 | A1 | 10/2009 | Wamble et al. | |
| 2009/0249974 | A1 | 10/2009 | Wamble et al. | |

FOREIGN PATENT DOCUMENTS

| | | | |
|---|---|---|---|
| JP | 53-13713 | * | 2/1978 |
| JP | 56-117909 | | 9/1981 |
| KR | 20-0445324 | | 7/2009 |

* cited by examiner

TRAIN YARD CLASSIFICATION SYSTEM

FIELD OF THE INVENTION

The present invention relates to a new, unique and innovative way to process railroad cars through a railroad yard or terminal.

BACKGROUND OF THE INVENTION

Railroads are important transportation systems for moving freight. When a freight train enters a major rail yard it must be broken down and the cars must be redistributed to new trains going to different destinations. The procedure for breaking down trains is labor intensive, dangerous, and time consuming and takes place in railroad "yards." Federal Railroad Administration ("FRA") statistics show that between 1994 and 1998 more than 6,400 accidents took place in railroad yards. Of these accidents, approximately 75 resulted in fatalities. Of these accidents 60% were associated with problems with switches and switching. Further, the labor intensive process adds a great deal of dwell time to the operation causing extended time lapses between train arrival and departure.

Railroad locations that process a number of railroad cars daily are generally referred to as "yards", which process from 50 to perhaps as many as 1500 cars per day. Many of these cars carry railroad containers. Railroad cars which carry two containers are called "double-stacks" because they carry containers that are stacked on top of each other.

Trains arrive at a railroad yard daily from outlying locations to the yard. The purpose of a railroad yard is to switch, or sort, rail cars so that they may be assembled into trains going to another yard at a new location. Cars in inbound trains to the yard are mixed up. For example, a train inbound to a yard in Columbia, S.C., may be carrying railroad cars that have ultimate destinations, such as Charlotte, N.C., Atlanta, Ga., Jacksonville, Fla., Kansas City, Mo., St. Louis, Mo., etc.

Each car in the inbound train must be sorted and put into the proper railroad track so that it can continue to travel to its ultimate destination on another train, much as passengers change planes in New York or Atlanta go from one plane to another to reach their destination.

The process takes place generally as follows. A train arrives at a rail yard and is "yarded" (stops) in a "receiving" yard track. The locomotive power is detached (uncoupled) from the rail cars, and proceeds to the locomotive engine service facility. Meanwhile, the train must be "bled" of its air, so that the rail cars can roll freely. When trains depart railroad terminals, the air lines between each car are pumped full of air, about 75 psi. When the air in the train line is pumped up, all of the brakes on the rail cars are released. When this occurs, metal or composite brake shoes on each rail car come away from contact with the wheels of each rail car. At that point cars will roll freely. After the train is bled, the cars can be classified; i.e., rolled to the proper track for their outgoing destination. There are three typical ways to perform this process.

1. The rail cars are shoved to their proper class track by a locomotive(s). Once in their proper class track, the rail cars are "uncoupled" from the locomotive(s) or other rail cars ahead of them. "Uncoupling" is performed by a person on the ground who operates the mechanical uncoupling lever which is a mechanism on the side and end of each rail car.
2. The rail cars are catapulted to their proper track by revving up the speed of the locomotive(s) and by throwing switches which guide each car to its proper track. The switches are thrown by people on the ground who shunt the switches properly.
3. The rail cars are shoved up to the apex of a hill, and are separated at the apex by people who uncouple the cars. From the apex, the cars roll freely by gravity and are guided by switches which are automatically thrown by mechanical devices that are activated by a computer program to guide them to their proper track in the classification yard. This is referred to as a "hump" yard.

U.S. Pat. No. 3,727,559 describes an automated control system for the track switches on the hump tracks of a two-section classification yard having two inlet hump tracks interconnected by a cross-over, allowing manually controlled and automated routing of cars from each hump track to any destination track in either section of the yard. This system uses a hump and switches to control car classification from two humps.

In U.S. Pat. No. 3,865,042, a method and apparatus for controlling the positioning of switches in a railway classification yard is described to route to their respective destination tracks successive cuts from a train, as they are uncoupled at the hump of the yard. As described, a computer receives information respecting the location of the various cuts as they are traveling through the yard and operates the various switches in the yard to route each of the cuts to its destination track. This system uses a method and apparatus for controlling the position of switches in a railway classification yard so as to route successive cuts from an incoming train to designated tracks in the classification yard. This is a gravity system and requires switches to function.

U.S. Pat. No. 4,610,206 describes a modular control system for railroad classification. As described, the control system can automatically perform those functions necessary to control various elements of a railroad classification yard to enable the train of cars to be switched from a hump track to one of a plurality of bowl tracks in accord with the destination for the car. This is a modular control system that is used in conjunction with a hump and switches.

In U.S. Pat. No. 4,487,547, a car positioning device is described for dumping of random cars in a rotary dumper, and a method for directly positioning cars within a rotary dumper, where the car positioning device, movable on a trackway parallel to a track portion carrying railroad cars, has a carriage base and a pivoted car positioning arm to directly position a car within the dumper. This system uses a track parallel to a track on which the incoming rail cars reside. On this parallel track is an apparatus having a L-shaped arm that moves the cars on the rail car track.

U.S. Pat. No. 5,758,848 describes an automatic switching system integrated into freight cars that includes a microcomputer for controlling the automatic system and regulating the shunting speed, a rotary pulse generator for determining the shunting distance and freight car speed, distance sensors for detecting distance to and difference in speed relative to cars in front, an automatic coupling, a brake system for controlling the speed of the freight cars in the shunting zone and precise target braking on the sorting tracks and a data transmission device for information exchange with a superordinated control station. This system uses a device or devices on each freight car to control car speed when a car is humped. This gravity system also requires switches to function.

In U.S. Pat. No. 6,418,854, a new method for sorting railroad cars is presented, whereby outbound trains are built in proper standing order for departure directly on classification tracks using a continuously sustainable multi-stage sorting process. As described, single car sorting is efficiently performed at the hump, but one additional hump operation is required to replace the flat switching which is eliminated by this method. This system requires an additional hump to provide multi-stage sorting of rail cars. This gravity system also requires switches to function.

U.S. Pat. No. 7,596,433 describes a system for computing car switching solutions in a railway switch yard. Implementation of the system can be provided for the traditional switching mechanisms, e.g., the hump switch and the flat switch. This system uses a circular series of tracks and a hump to sort cars. It is a gravity system and also requires switches to function.

However, there still is a need to improve safety, cleanliness, efficiency and economy of switching cars from incoming trains to appropriate outgoing trains in a railroad yard.

BRIEF SUMMARY OF THE INVENTION

The present invention provides a system and method for switching cars from incoming trains to appropriate outgoing trains in a railroad yard. In accord with the invention, a railroad car transfer and classification system for transferring and classifying railroad cars from incoming trains to appropriate outgoing trains in a railroad yard comprises a rail yard having one or more transfer tables, each capable of moving two or more railroad cars from tracks in a receiving yard to tracks in a classification yard and, preferably, a controller with software to control the movement of railroad cars and the transfer table(s). Preferably, the switching system also comprises car indexers and automated uncoupling devices to facilitate railroad car transfer.

In one embodiment, a system for transferring railroad cars from incoming receiving tracks to classification tracks for building outgoing trains comprises a plurality of incoming receiving tracks, a plurality of outgoing classification tracks, and one or more transfer tables for moving railroad cars from the incoming receiving tracks to designated outgoing classification tracks, each transfer table having a plurality of track segments.

In another embodiment of the invention, a method is provided for transferring railroad cars from incoming receiving tracks to classification tracks for building outgoing trains. The method comprises:

a) providing a railroad yard comprising:
a plurality of incoming receiving tracks;
a plurality of outgoing classification tracks; and
one or more transfer tables for moving railroad cars from the incoming receiving tracks to designated outgoing classification tracks,
each transfer table having a plurality of track segments;

b) receiving incoming railroad cars on a plurality of incoming receiving tracks;

c) uncoupling a first car from a following second car on each of the plurality of incoming receiving tracks having cars;

d) moving the uncoupled first car from each of the plurality of incoming receiving tracks onto a corresponding track segment onto the transfer table;

e) moving the transfer table to align a selected track segment with an appropriate classification track for the corresponding railroad car on that track segment and transferring the car to the classification track;

f) continuing to move and align the transfer table track segments with appropriate classification tracks as set forth in step e) until each railroad car has been transferred to the appropriate classification track;

g) moving the transfer table to align with the incoming receiving tracks for transfer of the following second car from the receiving track to the transfer table; and h) repeating steps d) through g) until all of the cars on the incoming receiving tracks have been classified and transferred to classification tracks or held back for later transfer.

In another embodiment of the invention, a method for transferring railroad cars from incoming receiving tracks to classification tracks for building outgoing trains comprises:

a) providing a railroad yard comprising:
a plurality of incoming receiving tracks;
a plurality of outgoing classification tracks; and
one or more transfer tables for moving railroad cars from the incoming receiving tracks to designated outgoing classification tracks,
each transfer table having a plurality of track segments;

b) receiving incoming railroad cars on a plurality of incoming receiving tracks;

c) uncoupling a first car from a following second car on each of the plurality of incoming receiving tracks having cars;

d) moving the uncoupled first car from each of the plurality of incoming receiving tracks onto a corresponding track segment onto a first transfer table;

e) moving the cars on the first transfer table to a second transfer table;

f) moving the second transfer table to align a selected track segment with an appropriate classification track for the corresponding railroad car on that track segment and transferring the car to the classification track;

g) continuing to move and align the second transfer table track segments with appropriate classification tracks as set forth in step f) until each railroad car has been transferred to the appropriate classification track;

h) while steps f) and g) are being performed, transferring the following second cars from the receiving tracks to the first transfer table; and i) repeating steps c) through h) until all of the cars on the incoming receiving tracks have been classified and transferred to classification tracks or held back for later transfer.

The invention described herein has several important advantages over prior art. No humps or switches are required to transfer and classify cars from an incoming train to build the outgoing train. This invention can dispense with the need for various locomotives, railroad engineers, conductors and switchmen using railroad switches to sort out railroad cars in order to build trains. Additionally, it does so in a "clean" environment, because it eliminates the burning of diesel fuel during the process of sorting railroad cars.

BRIEF DESCRIPTION OF THE DRAWINGS

A detailed description of examples of implementation of the present invention is provided herein with reference to the drawings, wherein like components are labeled with like numerical designations.

DESCRIPTION OF THE PREFERRED EMBODIMENT

The process of classification begins when an inbound train arrives on the new or retrofitted receiving yard track, which is constructed in accord with the present invention. The train stops and the locomotive units are uncoupled from the train in accordance with each railroad's rules and regulations.

At this point, preferably, an automatic system bleeds the air from the train. It is comprised of a robotic device that runs on a trackway alongside or underneath the inbound train. Connected to the device is a hydraulic arm that reaches out and pulls the bleed rod on the side of each car adjacent to the device until the air is depleted in the rail car. At this point, the car will roll freely because the brakes are released on the rail car. The device continues to be powered alongside the train, pulling the bleed rods until all the rail cars in the train have been bled of their air. The device preferably is operated by controller run by a computer program that uses logic to identify a bleed rod, preferably, with optics in the robotic device. All of the components of the robotic system are controlled by the computer program.

Once all the rail cars are bled, the train is ready to be processed to the classification yard. So that the rail car is able to be processed, it must be uncoupled from the other cars behind it.

Figure 4:
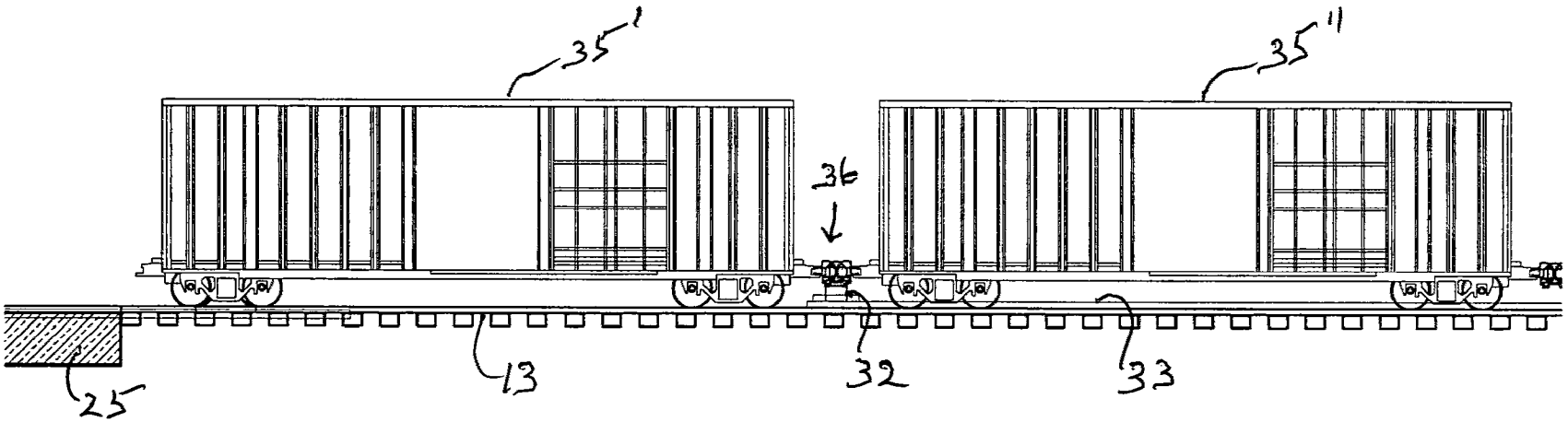
FIG. 4 is a schematic side elevational view of railroad cars illustrating positioning of an uncoupler mechanism that automatically uncouples the railroad cars prior to placement onto the transfer table (also herein called a "sorting table") in accord with an embodiment of the present invention.

At this point, an uncoupling device is used. It can be positioned below the train on a trackway under the rail cars or on a parallel trackway located adjacent the rail car track. Examples of an automated decoupler for rail cars are described in U.S. Pat. Nos. 5,531,337 and 3,901,390, the disclosures of which are hereby incorporated in their entirety by reference. Because most rail cars are between 40 and 89 feet long, the trackway preferably extends from about 40 feet from the transfer pit to about 100 feet from the pit. The length of the trackway is determined by the facility and the length of the rail cars to be processed. The automatic decoupler device must be able to find the location where the rail cars are coupled to each other. To do this, the device looks for the point of coupling for the car ready to be loaded onto the transfer table and the following car. It preferably uses a camera or other optical device mounted onto the uncoupling device. When it has identified the location where the cars are coupled together, in one embodiment (FIGS. 4-5) under computer control a hydraulically activated device with a square piston, approximately three feet on each side, elevates and makes contact with the lock lifter and pin assemblies of the two rail cars that are coupled to each other. The piston pushes against the assembly, which pushes the coupling pins on both cars upward, allowing the cars to be uncoupled from each other. Then the hydraulic piston lowers and waits for the first car to be moved onto a transfer table. The computer is updated with this information. Then, the following car is uncoupled as necessary at an appropriate time under control of the computer until the entire train is processed.

After the rail car is uncoupled from the following car(s), under control of the computer system, an "indexer" on the inbound receiving track moves the uncoupled car onto the transfer table. An "indexer" typically is a hydraulic device or metal rope pulley system that attaches to the axle of a rail car that is to be loaded onto the transfer table. It can move the car forward or backward. Examples of indexers are disclosed in U.S. Pat. Nos. 7,377,219, 6,006,673 and 4,354,792, the disclosures of which are hereby incorporated in their entirety by reference. Once the rail car is partially onto the transfer table, another indexer on the transfer table takes over and positions the car onto the table, preferably at a point where the car on the table is approximately six to twelve inches from the edge of the table opposite the inbound receiving track. At this point, the indexer on the inbound receiving track moves back to process the next car to be loaded onto the transfer table.

The transfer table typically is designed to hold anywhere from two to ten tracks on its surface. However, the number of tracks on the transfer table can be adjusted according to the facility and numbers of cars to be processed in a day.

Transfer tables are known. See, for example, U.S. Pat. No. 889,368, which discloses a normal surface transfer table, the disclosure of which is hereby incorporated in its entirety by reference. However, two or more tracks adjacent to each other on a transfer table is believed to be novel. The transfer table may be of a conventional design, running on rails or, preferably, the table may be magnetically levitated; i.e., the table may move on rails, or on a cushion of magnetic fields. Transfer tables useful in the practice of this invention typically will be guided on tracks and moved similarly to rail cars moved by indexers. Preferably, the transfer tables will utilize magnetic levitation. Magnetic levitation technology is well known and disclosed, for example, in U.S. Pat. Nos. 7,587,982, 7,380,508, 6,684,794, 6,418,857, 6,402,118, 5,168,183 and 4,324,185, and in U.S. Patent Application Publication Nos. 2009/0249974, 2009/0249973, 2009/0103227, 2008/0148991, 2008/0148990, 2008/0148988, 2007/0095245, 2006/0219128 and 2003/0217668, the disclosures of which are hereby incorporated in their entirety by reference.

After the cars are loaded onto the transfer table, hydraulic stabilizers, consisting of a power unit and pistons, attached to a frame on each side of each track segment on the transfer table, preferably are extended to the side of each car. The hydraulic stabilizers keep rail cars from tipping over when the transfer table is starting, moving and stopping.

The transfer table begins to move so that the first car can be put onto its proper classification track. The table moves from track to track until each of the cars is transferred to and classified on its appropriate classification track. The cars are moved from the transfer table by the indexers on the table. However, at a predetermined position, indexers on the classification tracks take over to continue moving the cars onto the classification tracks. Like other system components, the table preferably is controlled by a controller operated by a computer software program.

Typically, the table moves at a speed of from one to five miles per hour, stopping in front of the proper classification yard track, drawing the hydraulic stabilizer pistons away from the side of the car, activating the indexer underneath the car and unloading each car to its designated track under control of the computer system. The table moves on until the last car on the table is unloaded. The table then returns to the inbound receiving tracks to transfer the next cars.

When a rail car enters a yard classification track after unloading from the transfer table, it is again moved by indexers located on top of the track. The indexers move the car down into the classification track, creating enough space so that another car may be moved off of the table and coupled to it. Then the two cars are moved by the indexer to make room for the next car, etc.

The process as described above continues until all the railroad cars requiring processing are classified into their respective tracks, all under control of a computer system.

At some points in time during the classification process, a rail car may be "held back" before being placed into its proper classification track. An example would be a car of dynamite, or other explosives, or hazardous materials. Railroad and federal rules require that a potentially "explosive" rail car be place no closer than six cars from the trailing locomotive in a locomotive construct. Therefore, a track or multiple sets of tracks, with indexers, may be placed on the other side of the classification yard tracks to hold back a hazardous (e.g., explosive containing) car until five cars have been placed into the classification yard ahead of it. At this point, the hazardous car may be placed onto the yard classification track by appropriate control of the transfer table. When it is in place, the hazardous car is "buried," to use railroad terminology, and will be no closer than six cars from the locomotive in the locomotive construct. Thus, cars that must receive special handling are easily accommodated by systems in accord with the present invention.

Another use of "hold back" tracks on the side of the transfer table pit is to allow for flexibility to prevent "rehumps." A rehump car occurs when classification tracks reach their capacity and there is no space left in the track to put the rail car in its proper position in the classification tracks. As a result, such rehump cars are switched to another track in a conventional railroad yard. This often results in the rehump car missing its proper outbound train. Also, rehump cars must be handled again, taking time away from the sorting process.

In accord with certain embodiments of the present invention, by putting a car on a "hold back" track adjacent the transfer table pit, it can easily be attached to a series of cars as they are pulled out of the classification yard by crews building their outbound train. The number of tracks that can be built on the either side of the transfer table pit is limited only by physical size of the facility.

Currently, railroad companies use "pull-out" crews to build outbound trains from cars that are sorted into the classification yard. The reason for this is that in conventional railroad yards, many of the cars in the classification yard are not yet coupled, and some may be damaged during the conventional switching process. In processing and classifying cars in accord with the present invention, all of the cars in the classification yard will be coupled on the classification tracks, and the possibility that a car might be damaged is considerably reduced or avoided because no gravity feed is required. As a result, pull-out crews may be reduced or avoided, and the crews that service the railroad by taking trains from one yard to another preferably will build their own train. This can expedite rail cars to their destination.

The above description for processing rail cars uses one transfer table. However, more than one transfer table can be used in certain preferred embodiments of the present invention. For example, two transfer tables can be positioned adjacent each other in the transfer table pit so that rail cars loaded onto a first transfer table from the incoming receiving tracks are moved to a second transfer table. Then, while the second transfer table is moving the cars to appropriate classification tracks, the first transfer table can load the next cars from the inbound receiving tracks.

All of the steps and automatic equipment are controlled preferably by a controller with a suitable software application. Such applications are readily designed by persons skilled in the art of computer programming. The controller has appropriate configuration and memory for the task and may be in the form of a computer or computer board, or the like.

In some preferred embodiments, the computer control system also identifies and keeps track of the position of each car processed through the yard.

Figure 1:
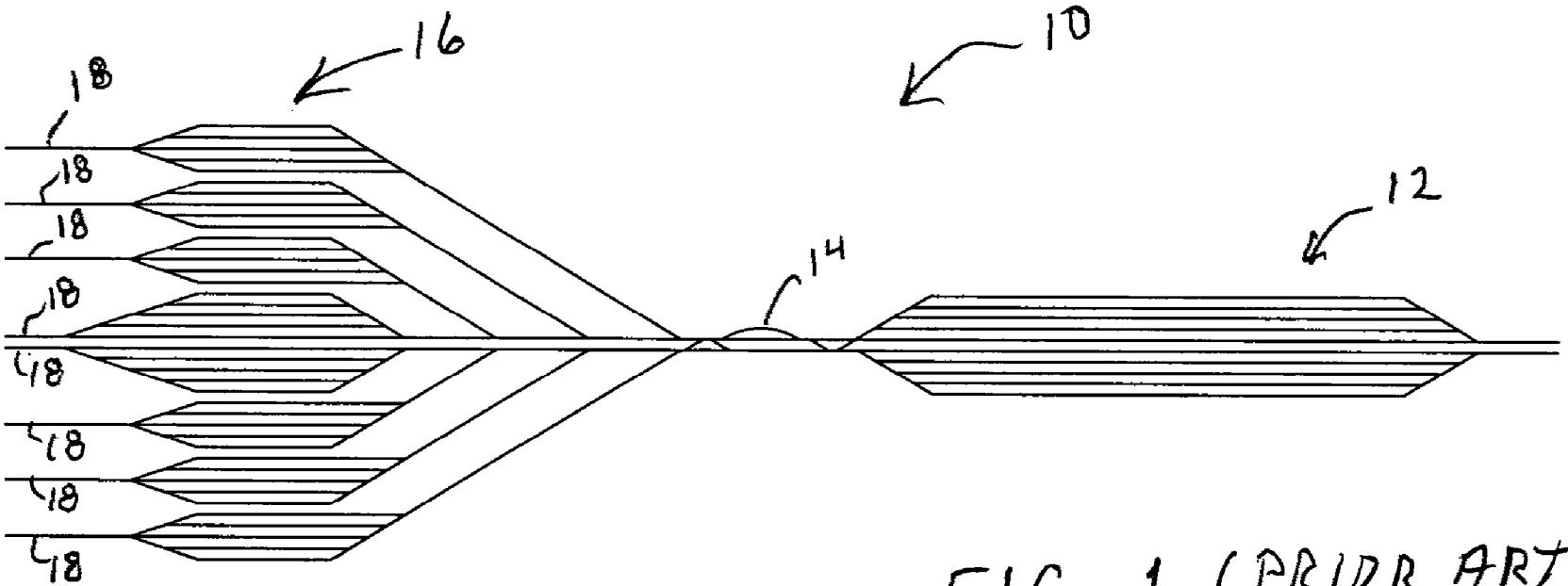
FIG. 1 (PRIOR ART)
FIG. 1 is a schematic plan view of a typical rail yard layout for a "Hump" yard.

FIG. 1 illustrates a simplified aerial schematic of a typical railroad yard 10 layout for classifying trains from their receipt in a receiving yard 12 to their sorting in a classification yard 14. This schematic is for a "hump" yard where rail cars are sorted by gravity. Other typical railroad yards are "flat" yards where railroad cars are sorted by catapulting them at sufficient speed with a locomotive, uncoupling the car or cars from the locomotive, and throwing switches to guide them to the proper classification track so that they are dispatched on the proper outbound train. A hump yard 10 typically includes receiving tracks 12, a hump 14, and classification tracks 16 leading to pull-out tracks 18. The receiving tracks 12 provide a switching queue in which cars delivered to the switching or hump yard await their turn to be switched to classification tracks 16 to build an outgoing train on the pull-out tracks 18. The hump 14 includes a set of tracks from the receiving tracks to the hump crest. Cars are uncoupled and pushed up to the hump crest at which point they roll by gravity to a designated classification track selected by throwing appropriate switches manually or automatically by computer control. Any railroad yard design can be retrofitted to accommodate the present invention.

Figure 2:
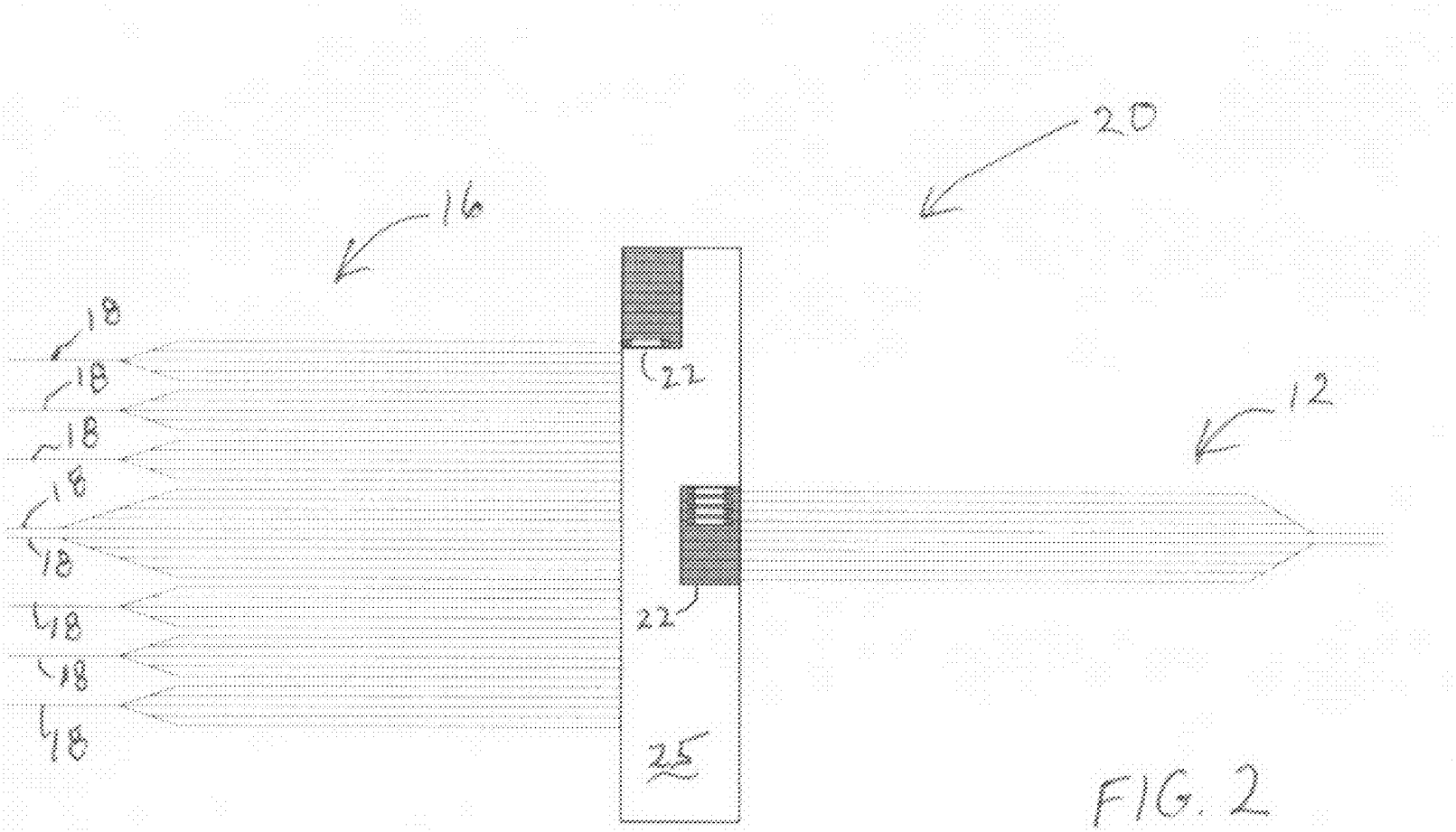
FIG. 2 is a schematic plan view of a typical rail yard after retrofitting with the components in accord with an embodiment of the present invention.

FIG. 2 illustrates how a switching yard 20 can appear after it is retrofitted or newly designed with components of The Robotic Yard Train Classification System in accord with one embodiment of the present invention. The area of sorting the railroad cars takes place with transfer tables 22 in the transfer table pit 25.

Figure 3:
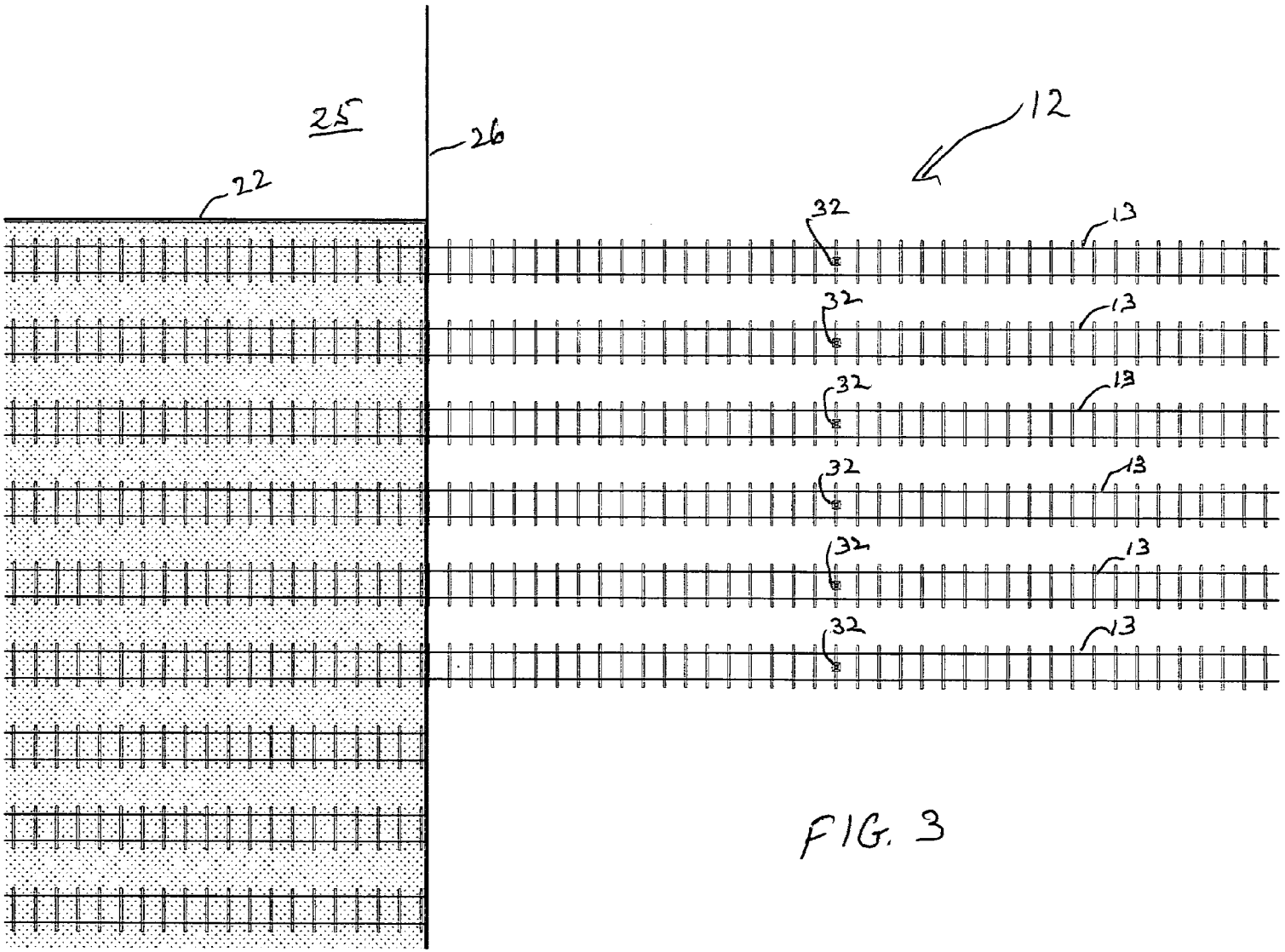
FIG. 3 is a schematic plan view of a receiving area where trains arrive in a typical railroad yard after retrofitting the switch yard area (also herein called "the robotic yard") where the railroad cars are sorted in accord with an embodiment of the present invention. In this area the locomotive(s) are decoupled and are moved into the robotic yard area for sending them to a locomotive facility.

FIG. 3 illustrates a close-up schematic showing how the receiving yard 12 area abuts the transfer table pit 25 area in FIG. 2. The transfer tables 22 move in a pit 25 with the edge 26 of the pit demarking the end of the inbound receiving tracks 13. Decoupler devices 32 are illustrated in a position to uncouple the locomotive and railroad cars. When a railroad car or locomotive is transferred across the edge 26 of the pit, preferably by railroad car movers called "indexers," onto a transfer table 22, the transfer table 22 can move the car to another location in the switching area where the car can be transferred to a classification track in the classification yard. The railroad car or locomotive can be transferred to a second transfer table as part of the process. In the set up depicted in FIG. 2, moving a car from the receiving yard 12 to the classification yard 16 requires transferring from one transfer table to a second transfer table. Cars and locomotives preferably are detached from each other by the use of an automatic decoupler, uncoupler 32 mechanism and, then, moved onto the transfer table by an indexer (not shown).

When each car stops before the transfer table pit 25 (FIG. 4), the uncoupler mechanism 32 (FIG. 4) operating on a trackway 33 locates the separation between the first car 35' and the second car 35" behind it and locates the couplers 36 joining the cars together. The uncoupler mechanism 32 is located on a trackway 33, which extends generally at least from about 40 feet from the transfer pit to about 100 feet from the transfer pit, and is between each set of the receiving tracks or under the rail cars. The uncoupler mechanism 32 moves on the trackway 33 after railroad cars 35 and/or locomotives 30 come to a stop and rides on the separate trackway under the locomotives and railroad cars. When the uncoupler mechanism 32 locates the couplers 36 joining the cars (or car and locomotive) together, a piston 34 is extended by the uncoupler mechanism 32 underneath the couplers 36 and presses upward against the lock, lifter and pin assemblies 37 coupling the two cars causing the pins to lift, thereby uncoupling the cars. Then the first car or locomotive can be moved onto the transfer table by an indexer. This process is repeated until all cars in the queue are processed and transferred to classification tracks.

Figure 5:
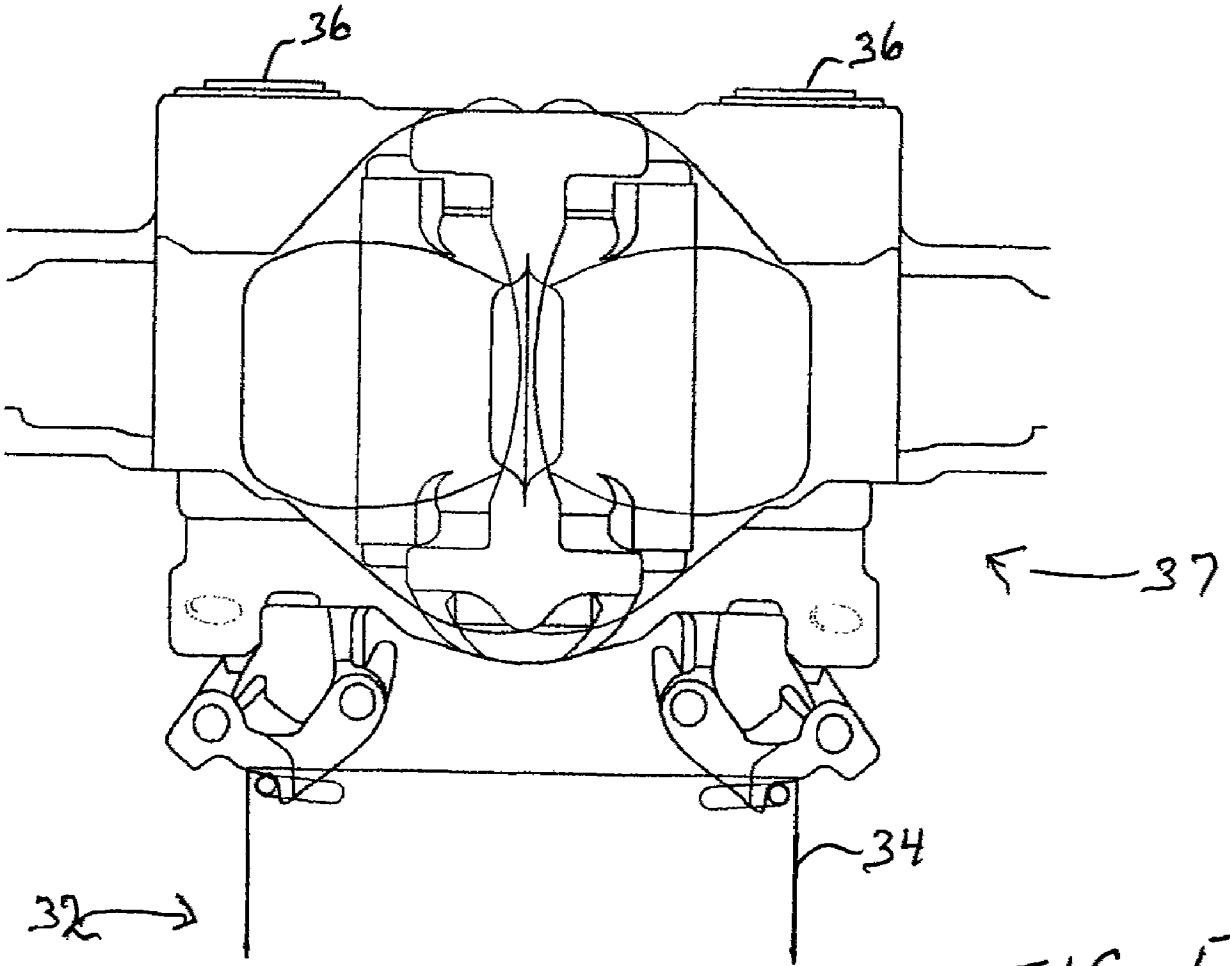
FIG. 5 is a schematic side elevational view of uncoupling the coupler mechanisms of two railroad cars in accord with an embodiment of the present invention.

FIG. 5 is a schematic side view of a coupler mechanism for cars or locomotives and an uncoupler device located underneath. In this instance, the couplers 36 are engaged with each other. To uncouple them, a piston 34 pushes upward against the lock lifter and pin mechanisms 37 which forces the coupler pins upward, releasing the coupler mechanisms from each other causing the two cars (or car and locomotive) to be uncoupled from each other.

Figure 6A:
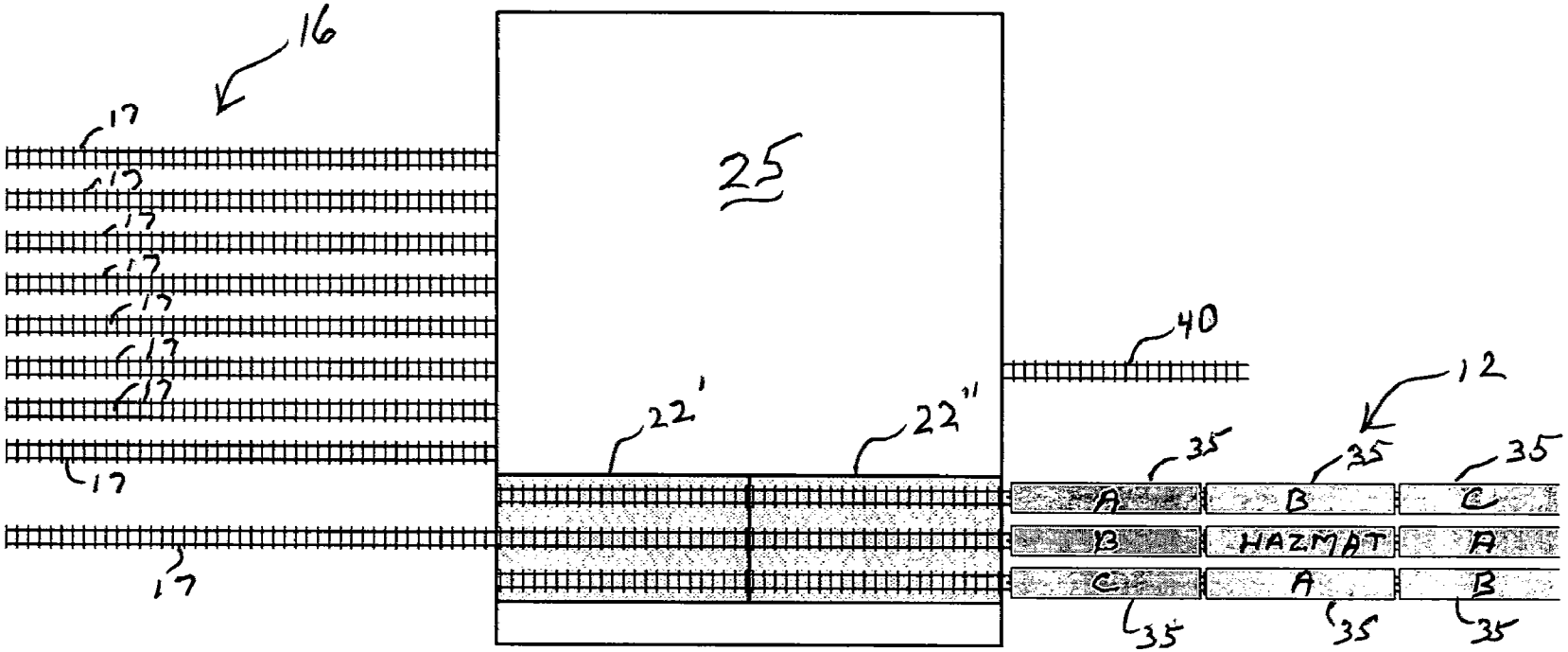
FIGS. 6A-H are schematic plan views illustrating how railroad cars are sorted in accord with one embodiment of the present invention by transfer tables from an inbound receiving yard to their respective classification tracks for their respective destinations.

A method for sorting railroad cars in accord with an embodiment of the present invention will be described with reference to FIGS. 6A-F. FIG. 6A shows a plan view of an inbound receiving yard 12, transfer Table 1 22' and transfer Table 2 22", which are located in the transfer pit 25, and an outbound classification yard 16. As illustrated, the inbound receiving yard 12 has three tracks 13 with railroad cars 35 queued on each (three cars shown in the queue on each track). The outbound classification yard 16 has nine tracks 17 illustrated, with three of the tracks specifically designated for "A" cars, "B" cars and "C" cars, respectively, and an engine (locomotive) escape track. The other tracks 17 can be specifically designated as necessary for sorting the incoming cars and building outgoing trains. Also, illustrated is a side track 40, for holding cars that are not ready to transfer to a classification track 17. The transfer tables 22', 22" each have three track sections. Capacity for a second outbound classification yard 16' is illustrated with dashed lines.

Figure 6B:
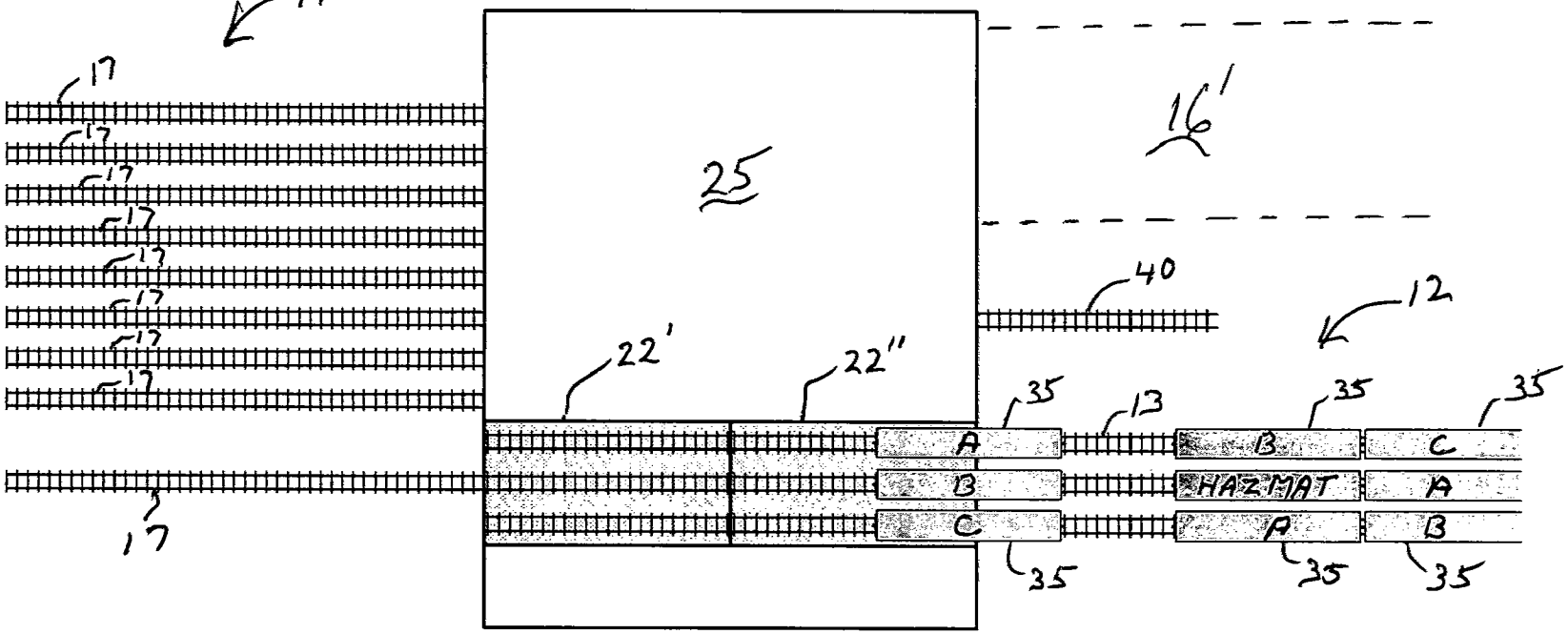
Figure 6C:
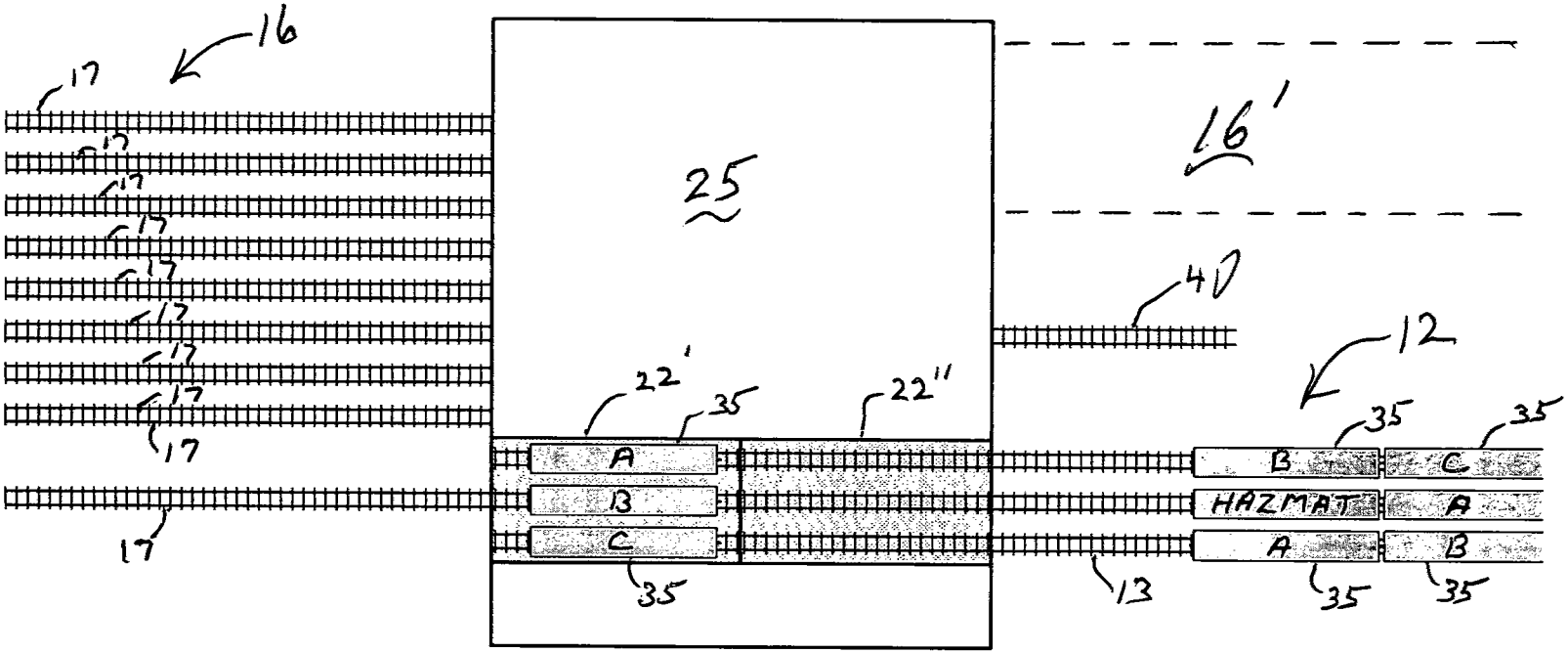
Figure 6D:
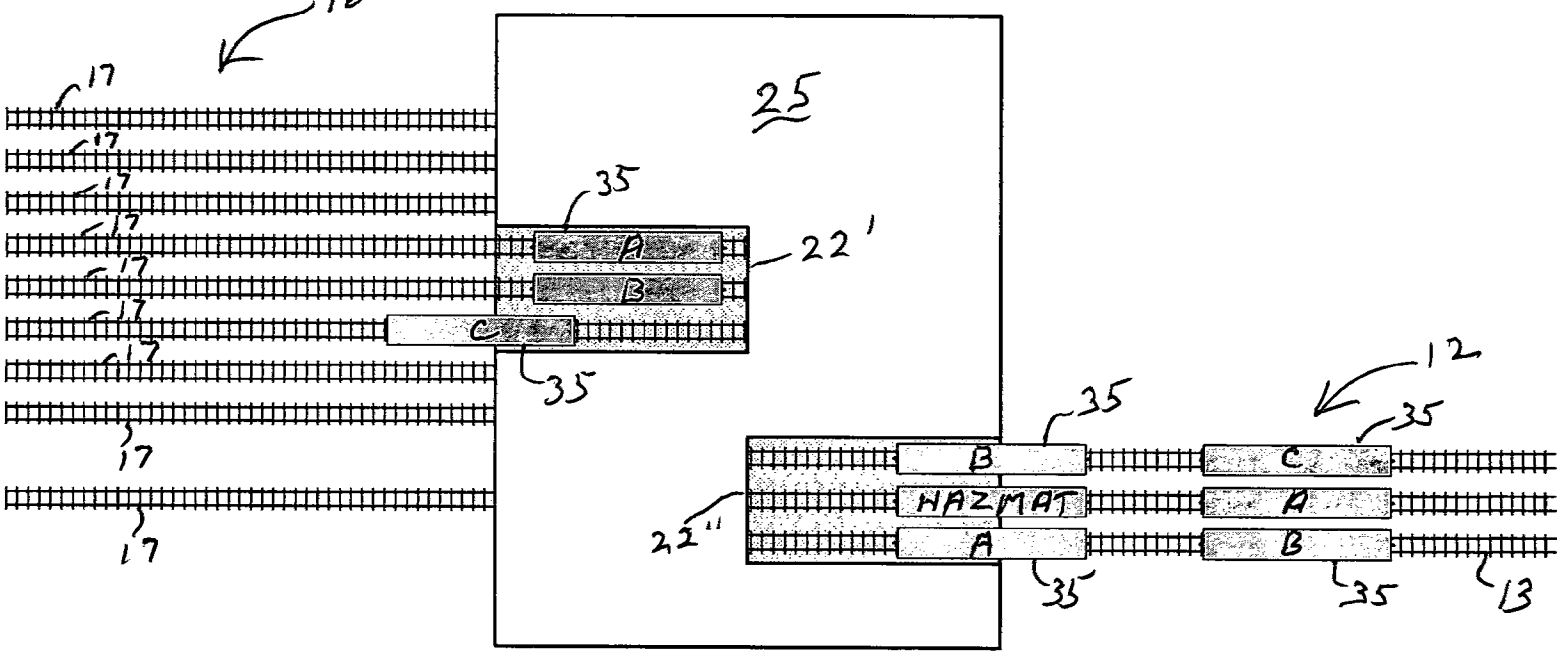
Figure 6E:
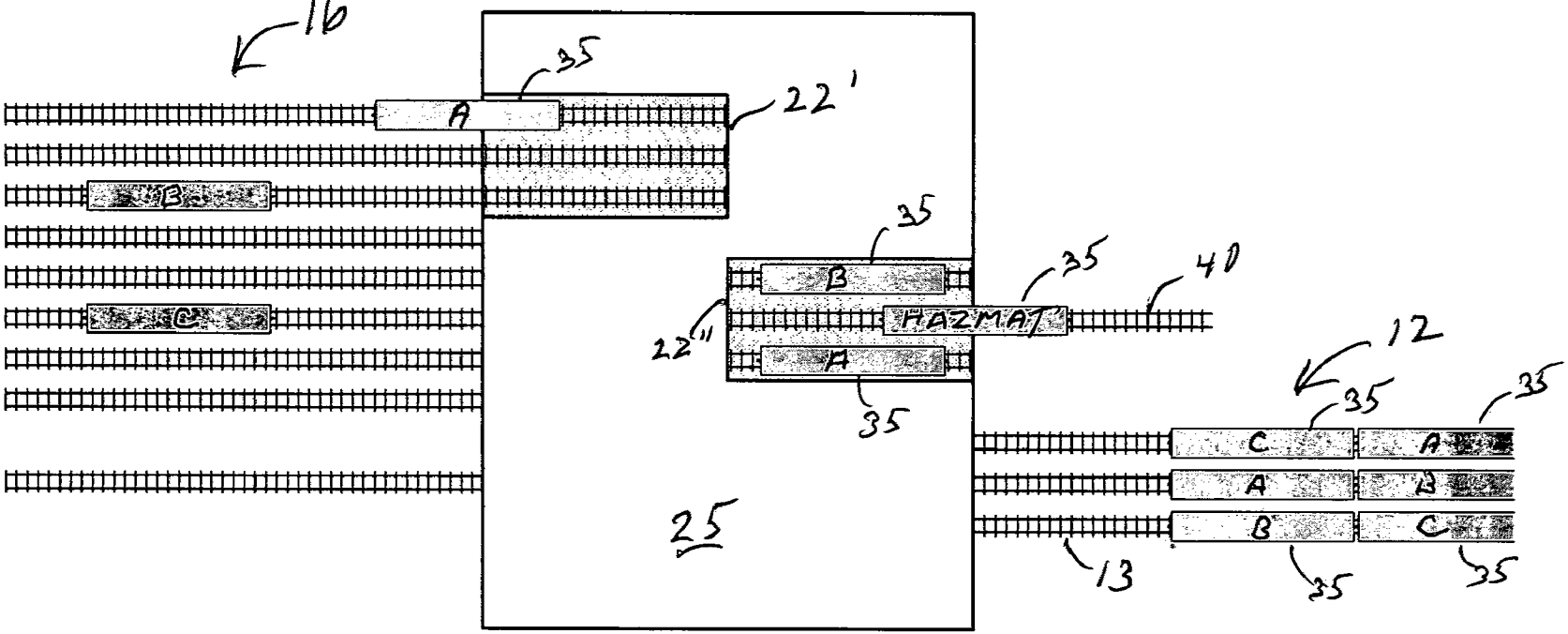
Figure 6F:
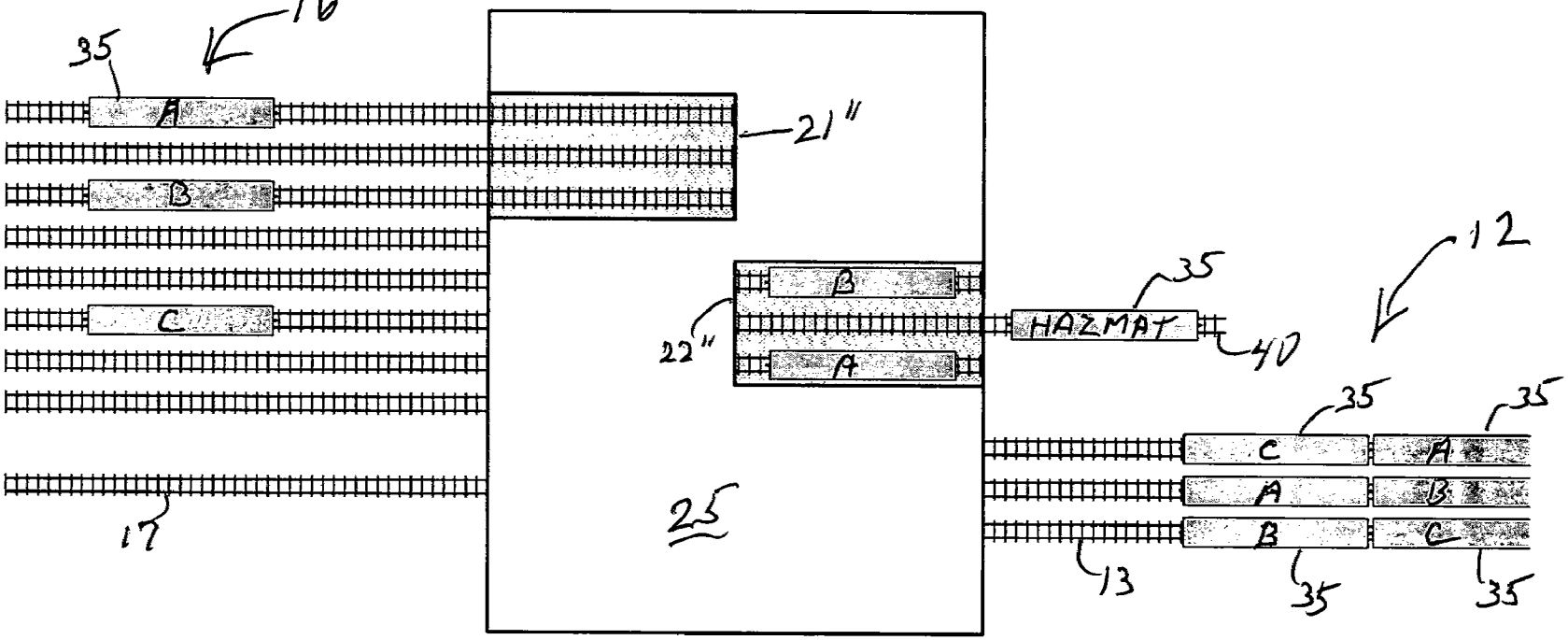
Figure 6G:
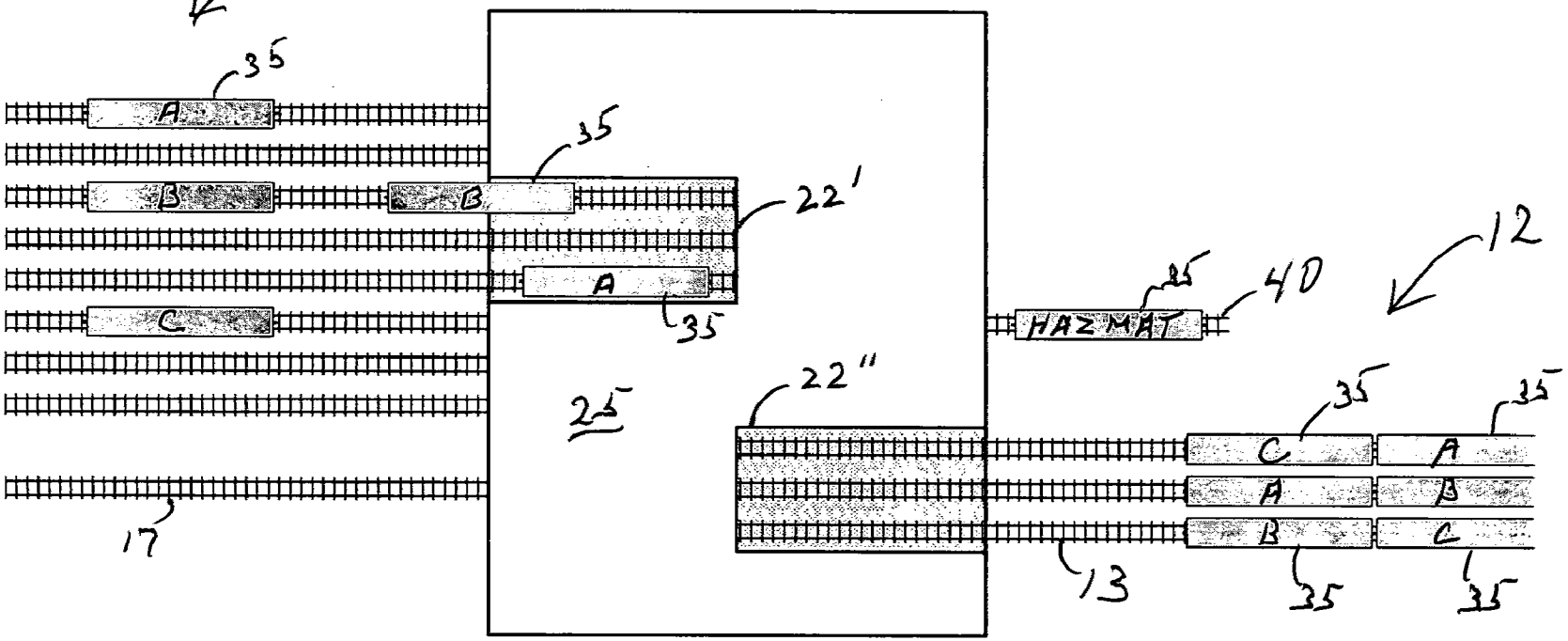
Figure 6H:
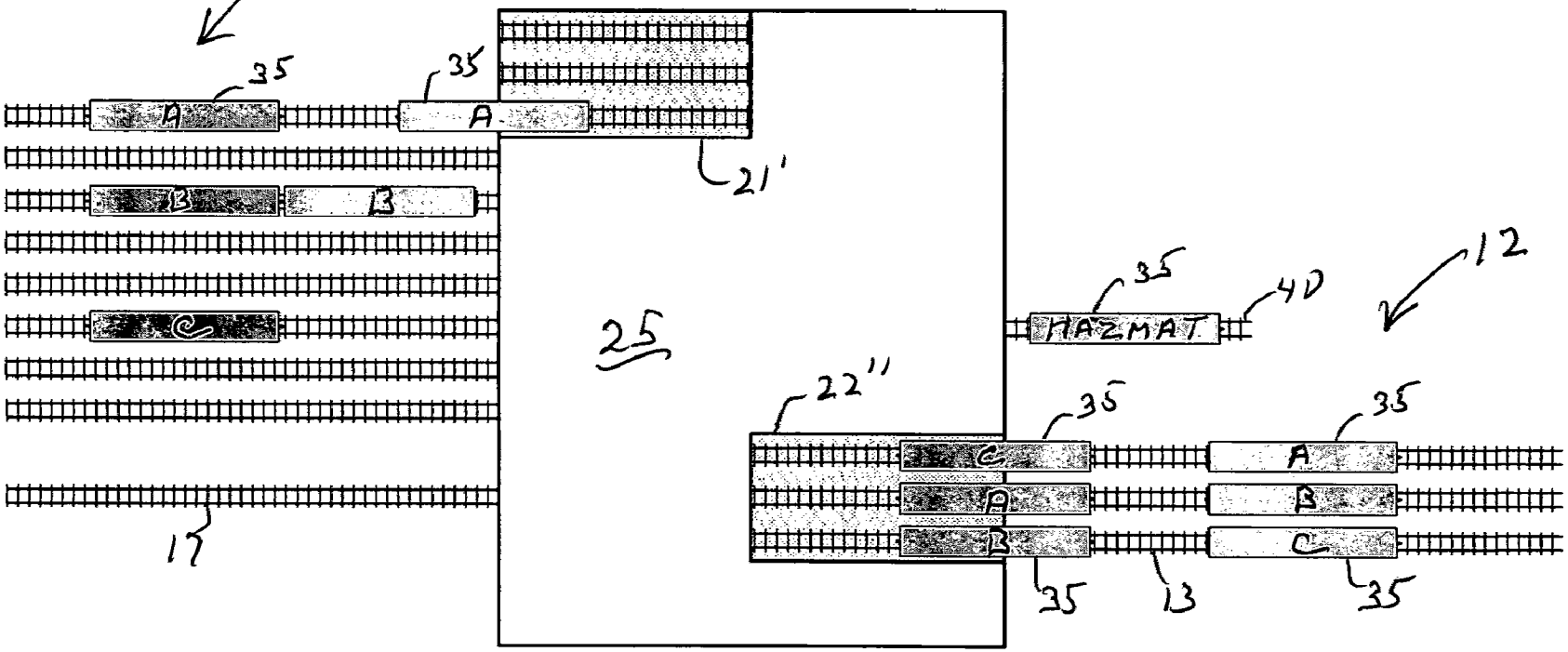
Figure 7:
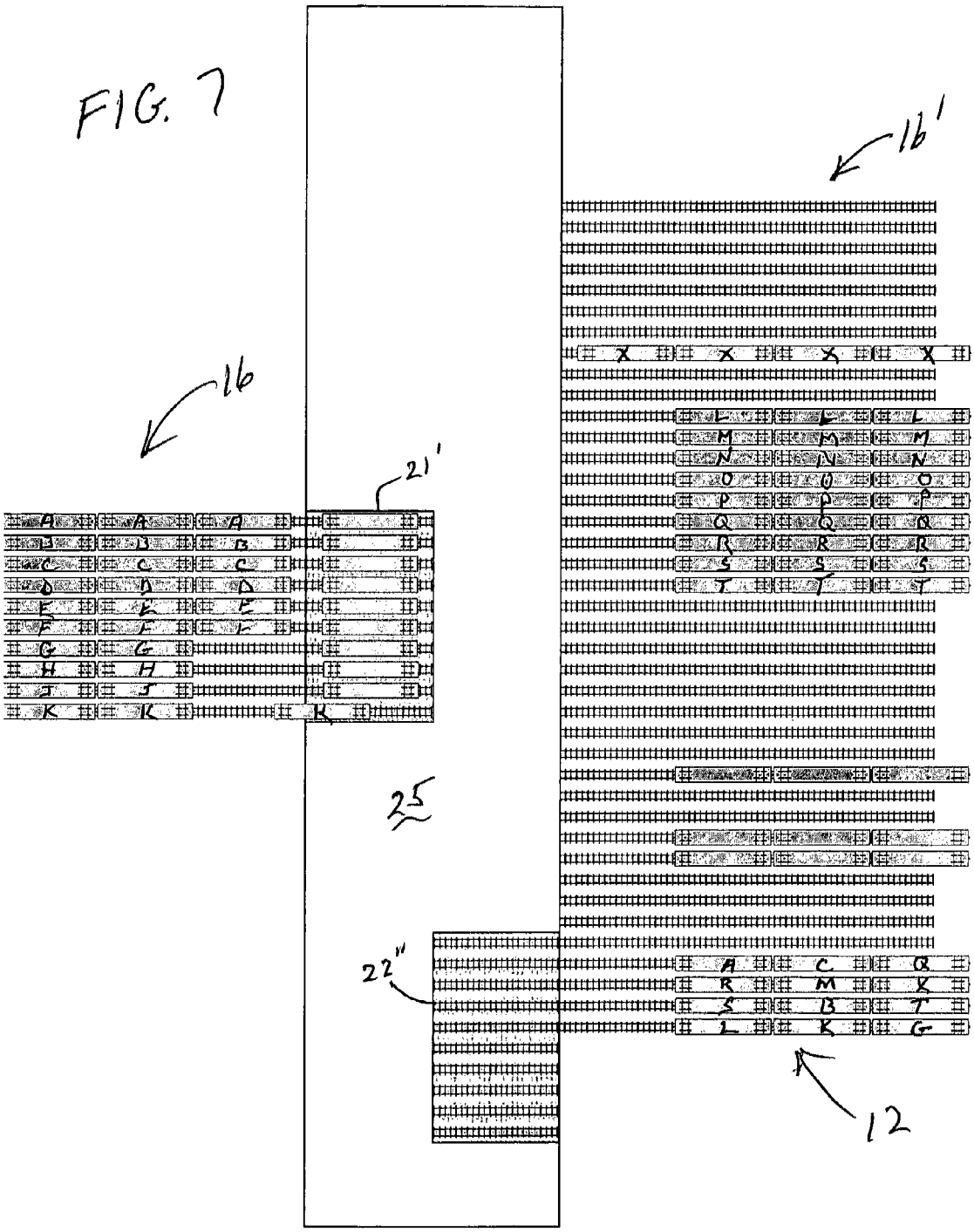
FIG. 7 is a schematic plan view of an expanded yard facility with two classification yards (16 and 16').

In accord with one embodiment of the invention, the three first cars, i.e., cars "A", "B" and "C", on the inbound receiving tracks 13 are uncoupled and moved onto transfer Table 2 (22"; FIG. 6B). Then, the three first cars are further moved onto transfer Table 1 (22'; FIG. 6C). Table 1 moves the three first cars to appropriate designated classification tracks 17 (FIG. 6D). While Table 1 is moving cars to designated classification tracks 17, three second cars, i.e., cars "B", "HAZMAT" and "A", are uncoupled from following cars and moved onto Table 2 (FIG. 6D). While Table 1 is finishing the transfer of the three first cars to designated classification tracks 17, Table 2 is transferring Car "HAZMAT" to the side holding track 40 (FIG. 6E). Then, Table 1 is moved adjacent Table 2 for transfer of the remaining two second cars onto it for transfer to designated classification tracks 17 (FIG. 6F). While Table 1 is transferring the remaining two second cars to designated classification tracks 17, Table 2 returns to position adjacent the inbound receiving tracks 13 to receive the next three cars (FIG. 6G). The next three cars, i.e., cars "C", "A" and "B" are moved onto Table 2 while Table 1 completes transfer of the its cars (FIG. 6H). This process is repeated until all of the cars have been transferred and classified.

Switching yards in accord with the invention can be constructed to accommodate processing additional numbers of incoming rail cars by adding receiving tracks and outgoing classification tracks. Several incoming receiving yard areas and several outgoing classification yard areas can be accommodated by appropriate sizing of the transfer pit, adjusting the number of tracks on transfer tables, and or using a plurality of transfer pits.

The invention has been described herein in considerable detail to provide those skilled in the art with the information needed to construct and use systems in accord with this invention. However, it is to be understood that the invention can implemented using components and equipment different from those described herein and any number of alternatives and modifications can be made by those skilled in the art upon consideration of this disclosure and the drawings without departing from the scope and concept of the invention.

I claim:

1. A method for transferring railroad cars from incoming receiving tracks to classification tracks for building outgoing trains, the method comprising:

a) providing a railroad yard comprising:
  a plurality of incoming receiving tracks;
  a plurality of outgoing classification tracks; and
  at least two transfer tables for moving railroad cars from the incoming receiving tracks to designated outgoing classification tracks,
  each transfer table having a plurality of track segments;

b) receiving incoming railroad cars on a plurality of incoming receiving tracks;

c) uncoupling a first car from a next following car on each of the plurality of incoming receiving tracks having cars;

d) moving the uncoupled first car from each of the plurality of incoming receiving tracks onto a corresponding track segment onto a first transfer table, whereby the next following car becomes a first car on the incoming track until there are no more following cars;

e) moving the cars on the first transfer table to a second transfer table;

f) moving the second transfer table to align a selected track segment with a classification track for the corresponding railroad car on that track segment and transferring the car to the classification track;

g) continuing to move and align the second transfer table track segments with classification tracks for the corresponding railroad car on that track segment of the second transfer table as set forth in step f) until each railroad car has been transferred to a classification track;

h) while steps f) and g) are being performed, transferring the next first cars from the receiving tracks to the first transfer table; and i) repeating steps c) through h) until only one car remains on the incoming receiving tracks and repeating steps d) through g) for the last car so that all of the cars on the incoming receiving tracks have been classified and transferred to classification tracks or held back for later transfer.

2. The method of claim 1, wherein the transfer tables are magnetically levitated.

3. The method of claim 1, wherein the railroad yard further comprises a trackway below or adjacent to the incoming receiving tracks, and the method includes positioning an uncoupling device on the trackway to uncouple the railroad cars for moving onto the transfer table.

4. The method of claim 1, wherein the railroad yard further comprises indexers positioned for use on the track segments on each transfer table and on the outgoing classification tracks for moving the railroad cars, and steps e and f move the railroad cars by means of the indexers.

* * * * *